United States Patent [19]

Derbidge et al.

[11] Patent Number: 4,570,551

[45] Date of Patent: Feb. 18, 1986

[54] FIRING OF PULVERIZED SOLVENT REFINED COAL

[75] Inventors: T. Craig Derbidge, Sunnyvale, Calif.; James A. Mulholland, Chapel Hill, N.C.; Edward P. Foster, Macungie, Pa.

[73] Assignee: International Coal Refining Company, Allentown, Pa.

[21] Appl. No.: 586,907

[22] Filed: Mar. 9, 1984

[51] Int. Cl.[4] ..... F23D 1/00

[52] U.S. Cl. ..... 110/263; 110/347

[58] Field of Search ..... 110/263, 347, 264

[56] References Cited

U.S. PATENT DOCUMENTS

| | | | |
|---|---|---|---|
| 4,294,178 | 10/1981 | Borio et al. | 110/263 X |
| 4,421,039 | 12/1983 | Llinares, Jr. | 110/263 |
| 4,425,855 | 1/1984 | Chadshay | 110/263 |

*Primary Examiner*—Edward G. Favors

[57] ABSTRACT

An air-purged burner for the firing of pulverized solvent refined coal is constructed and operated such that the solvent refined coal can be fired without the coking thereof on the burner components. The air-purged burner is designed for the firing of pulverized solvent refined coal in a tangentially fired boiler.

7 Claims, 3 Drawing Figures

FIRING OF PULVERIZED SOLVENT REFINED COAL

The Government of the United States of America has rights in this invention pursuant to Contract No. DE-AC05780-R03054 (as modified) awarded by the U.S. Department of Energy.

BACKGROUND OF THE INVENTION

This invention relates generally to the art of firing pulverized solvent refined coal in a burner for a boiler or the like.

Solvent refined coal, also known as SRC-I, is a low sulfur, low ash, solid fuel produced from coal and having a composition such that it could be used as a utility boiler fuel which can be burned under environmentally acceptable conditions. Solvent refined coal is produced by the dissolution and hydrogenation of pulverized coal in a process-derived solvent. The resulting process stream is flashed to remove hydrogen and like gases, processed via critical solvent, by filtration or by other methods to remove undissolved coal and ash, and then fractionated to separate byproduct gases and distillable liquids, recycle process solvent, and the solvent refined coal product. The solvent refined coal yield is the hydrocarbon fraction having a boiling point substantially greater than 850° F. and generally represents 40 to 70 percent of the moisture ash free feed coal.

The solvent refined coal can be further hydroprocessed to produce more distillable liquids and another hydrocarbon fraction having a boiling point substantially greater than 850° F. which is a product solvent refined coal.

As to its physical characteristics, solvent refined coal typically has a sintering temperature of 170° F., a melting point of 284° F., a specific gravity of 1.24 grams per cubic centimeter and a bulk density of 50 lbs per cubic foot as received. Also, solvent refined coal has a heating value which is considerably higher than that of coal, namely, about 15,600 Btu/lb under dry conditions. Also, solvent refined coal has a low melting point, in the range of 280°–300° F., and can become tacky at temperatures as low as 170° F. The solvent refined coal after hydroprocessing normally has a lower melting point. Thus, for successful pulverization, the internal mill temperature should not exceed approximately 150° F. In addition, to avoid fouling and coking of solvent refined coal on burner surfaces, cooling of the burner has heretofore been required.

In addition to its potential to be a very clean burning (low pollution) fuel, solvent refined coal (hereinafter SRC) could be fired in utility boilers originally designed to fire oil. Testing is under way by the U.S. Department of Energy to determine the suitability of solvent refined coal as a utility boiler fuel. Pursuant to this testing and in the contemplated use of SRC as a boiler fuel, the SRC is finely pulverized and then injected pneumatically into the furnace in a manner similar to that used for pulverized coal firing.

The firing of SRC involves several problems. Firstly, because SRC begins to soften at about 170° F., there is a tendency for SRC to plug the tubes through which the SRC fuel is injected into the furnace. Another problem is that the solvent refining process removes only minor amounts of the nitrogen in the fuel wherefore the SRC must be fired in a manner such that excessive oxides of nitrogen ($NO_x$), which is an air pollutant, are not produced.

The conventional approach to solving the first-mentioned problem is to provide for the water-cooling of the fuel injection tube so that the SRC fuel will not soften and adhere to it. The water-cooled fuel tube burners are sensitive to firing conditions such as fuel tube position and air swirl, and have a tendency to accummulate fuel deposits. Also, water-cooled burners are complicated to design, fabricate and maintain because of the numerous small water passages that are required. Further, to date, water-cooled burners have only been tested in wall-fired boilers (i.e., boilers in which the burners are positioned in rows on one or two furnace walls and fire in a direction perpendicular to the walls. At present, no water-cooled burners have been developed and proven for tangentially fired boilers in which the burners are positioned in the four corners of the furnace and fire in a direction just off the diagonals of the furnace to produce a fireball in the center of the furnace.

SUMMARY OF THE INVENTION

It is the general object of this invention to provide a burner for firing pulverized solvent refined coal which burner is air-purged and avoids the problems of burner fuel tube plugging.

A more specific object of the invention is to provide an air-purged burner of the indicated type which can be used for the firing of solvent refined coal in tangentially fired boilers and which avoids fuel tube plugging and results in $NO_x$ emissions of environmentally acceptable levels.

A further object of the invention is to provide an air-purged burner of the indicated type which is simple in design and can be manufactured, operated, and maintained at a low cost as compared with a water-cooled burner.

The burner in accordance with the invention has been developed and successfully tested in a pilot-scale facility (firing capacity 1.5 million Btu/hr under the above-mentioned contract of the Department of Energy. Pursuant to this design, the burner fuel tube plugging is avoided by air cooling the fuel tube, controlling the fuel injection jet shape, and by "blowing" the flame off the fuel tube tip so that the flame initiates at a location spaced from the end of the fuel tube tip. The flame is blown off the fuel tube tip using a high injection air velocity (such as, for example, 136 ft/sec). By way of example, the high injection air velocity is such that it causes the base of the flame to be removed from the tip of the fuel tube by a distance equal to approximately six times the diameter of the fuel tube. Removing the flame from close proximity to the tip of the fuel tube reduces the amount that the fuel tube is heated by the flame, and since the fuel tube is heated less by the flame, it can be successfully cooled by air wherefore no water cooling is required. Also, there is a reduction in the amount of solid fuel that could contact hot fuel tube or burner surfaces.

In accordance with the prior art teaching, it would seem that under normal conditions the blowing of the flame off the fuel tube would cause an excessive production of $NO_x$. However, pursuant to the invention, it has been discovered that for the firing of SRC fuel in a tangential arrangement, the flame can be lifted off the fuel tube in a manner as set forth above in accordance with the invention and the $NO_x$ emissions can still be held at low levels, even below the new source performance standards (NSPS) specified by the U.S. federal government for utility boilers, i.e., 0.5 lb $NO_2$/million Btu.

Thus, in accordance with the invention there is provided a simply designed air-cooled burner for the firing of pulverized solvent refined coal in tangentially fired boilers which avoids fuel tube plugging and results in $NO_x$ emissions below NSPS requirements. Moreover, while the burner in accordance with the invention has been developed for tangentially fired boilers, its use is applicable to wall-fired boilers and other combustion devices as well, in which case appropriate steps must be taken to reduce the $NO_x$ emissions if regulations are exceeded.

DETAILED DESCRIPTION OF THE PREFERRED EMBODIMENT

Figure 1:
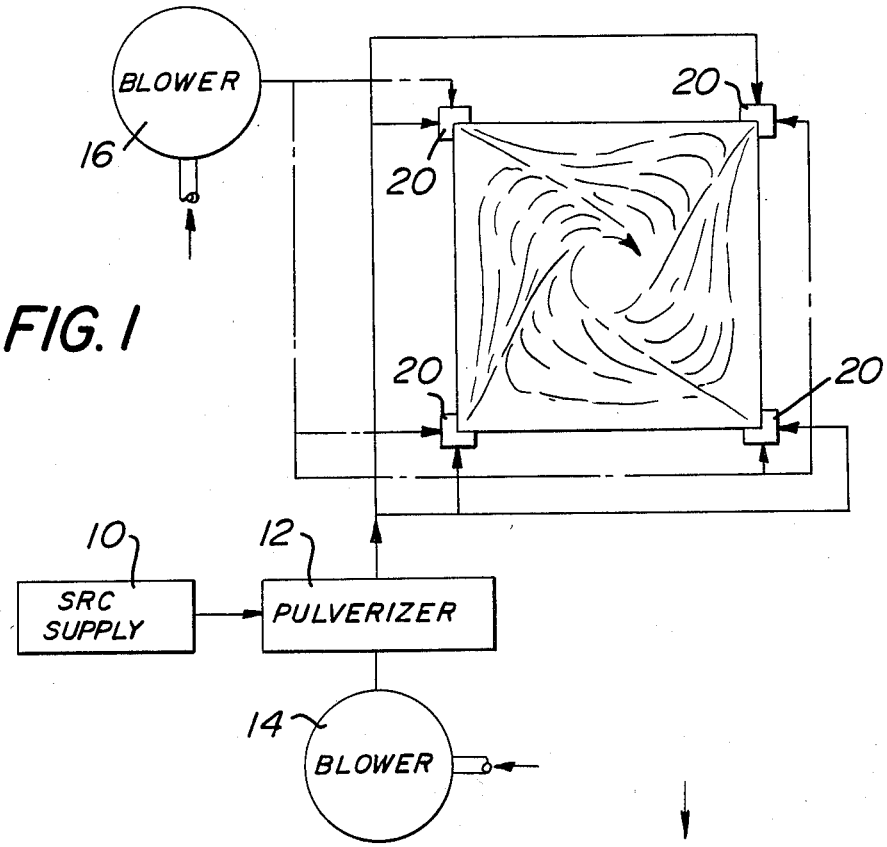
FIG. 1 is a schematic view showing a typical combustion system for the firing of solvent refined coal in a tangentially fired boiler.

The firing system for solvent refined coal shown in FIG. 1 comprises a suitable solvent refined coal supply 10, which typically comprises a hopper and a feeding mechanism that delivers the solvent refined coal to a pulverizer 12. Primary air is delivered by a blower 14 through the pulverizer 12 whereat the air entrains pulverized solvent refined coal and delivers a primary air-SRC fuel mixture through suitable flow lines to four burners 20 located in the corners of a tangentially fired furnace 18. Secondary air is also delivered to the burners 20 by way of the suitable means, not shown in FIG. 1. Purge air is delivered to the burners 20 by a blower 16 and suitable flow lines shown in dashed lines in FIG. 1. The burners 20 fire into the furnace 18 in a direction just off the furnace diagonals to produce a fire ball in the center of the furnace 18 as is conventional in tangentially fired furnaces.

Figure 2:
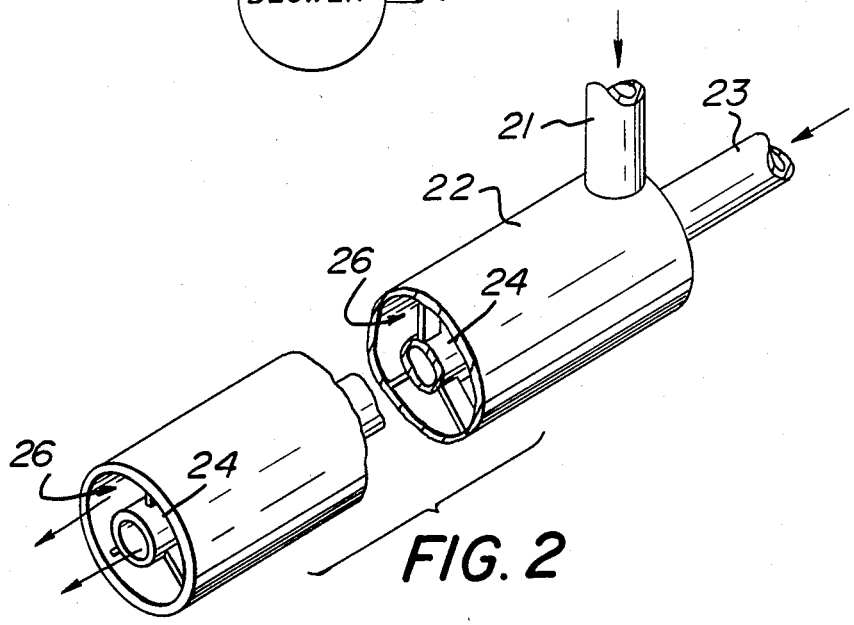
FIG. 2 is a view of the burner in accordance with the invention.

A burner 20 in accordance with the invention is shown schematically in FIG. 2 and comprises a pair of concentrically mounted burner tubes 22 and 24 providing an annular flow passage 26 therebetween. The inner burner tube 24 received a mixture of primary air and SRC fuel from the supply thereof as shown in FIG. 1 by way of an axially arranged supply pipe 23. Purge air (at ambient temperature) is delivered to the annular flow passage 26 by way of a supply pipe 21 receiving the flow from the purge air supply as shown in FIG. 1 the purge air passing through passage 26 in a straight path with no swirl.

By way of example, for a $\frac{5}{8}$ inch diameter inner tube and a $1\frac{1}{8}$ inch diameter outer tube, the primary or injection air velocity is 136 ft/sec at 22 percent injection air and the purge air velocity is 66 ft/sec at 25 percent purge air, the indicated percentages being a percent of air theoretically required for combustion. Also the normal fuel tube firing capacity of this example is 375,000 Btu/hr. The ends of either tube 22 or 24 could be formed into diverging nozzels or tapered to sharp edges to improve the gas-solid flow patterns as desired.

Figure 3:
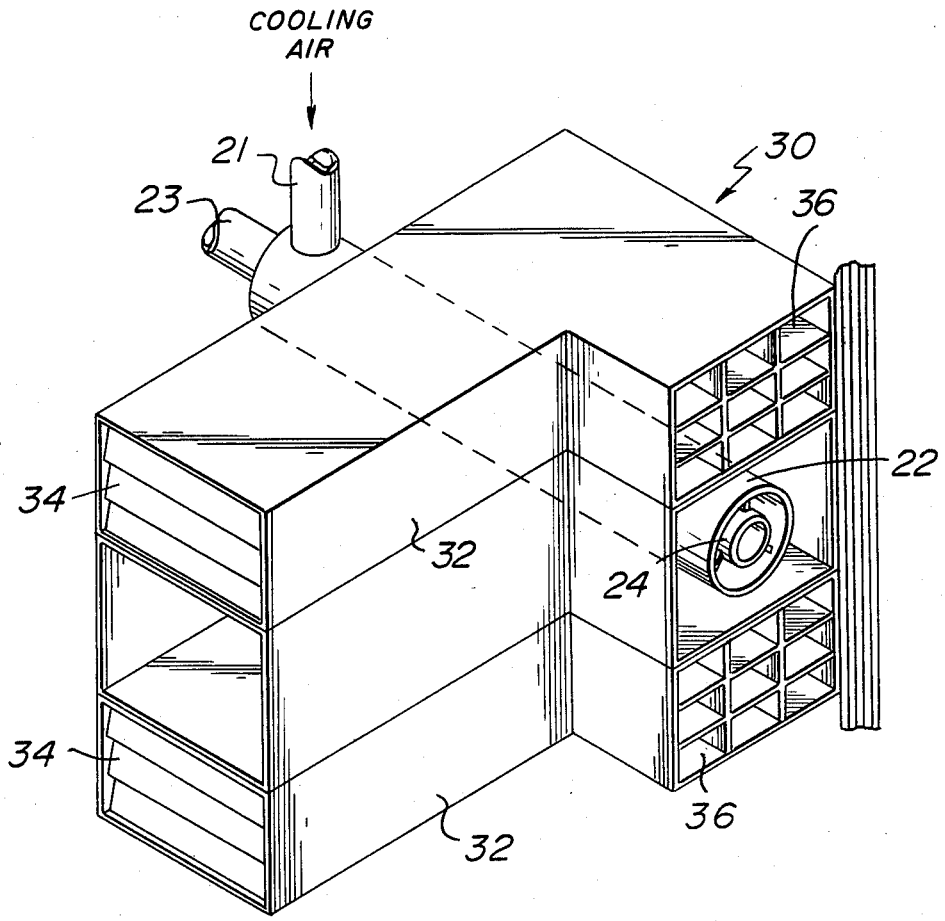
FIG. 3 is a fragmentary perspective view showing the burner in accordance with the invention mounted in a furnace corner.

FIG. 3 is an illustration of the manner in which the burner in accordance with the invention is installed in the corner of a furnace. As is illustrated, the burner tubes 22 and 24 are mounted to extend through the middle of a conventional corner windbox 30 for tangential firing. Windbox 30 is provided with a pair of secondary air ducts 32 having secondary air dampers 34 their inlet end and secondary air nozzles 36 at their discharge end. By this arrangement, a controlled amount of secondary air is delivered through nozzles 36 above and below the discharge end of the burner tubes 22 and 24 so that the secondary air mixes with the air and SRC fuel mixture being discharged from the burner tubes 22 and 24. Pursuant to the invention, the base of the flame is lifted from the tip of the burner tubes 22 and 24 so that the flame is initiated a substantial distance from the burner tubes 22 and 24. The flame is caused to be lifted from the tip of burner tubes 22 and 24 because of the high velocity of the air-SRC fuel mixture in combination with the fact that the purge air is introduced with no swirl. In accordance with the invention, this distance is preferably at least about six times the diameter of the fuel burner tube 24. Under some conditions, a feasible distance may be from about 2–6 times the burner tube diameter. The arrangement whereby the flame is removed from close proximity to the tip of the fuel burner tube 24 serves two purposes. One, it reduces the amount of impingement of SRC fuel particles. Two, it reduces the amount that this tube is heated by the flame. Since the fuel tube 24 is heated less by the flame, it can be cooled successfully by the purge air that flows in the annular passage 26 surrounding the fuel tube 24. The purge air typically is at ambient temperature.

Burner 20 will be provided with a suitable pilot gas supply, spark igniter and other conventional means for starting and maintaining the burner flame. These well-known devices have been omitted from the drawings for the sake of clarity of illustration.

EXAMPLE

An air-cooled solvent refined coal burner in accordance with the invention has been demonstrated in a pilot-scale test facility having a firing capacity of 1.5 million Btu/hr and arranged to simulate a tangentially fired boiler. The nominal firing conditions for this test were as follows:

Fuel fired = SRC
Firing rate = 1.45 million Btu/hr
Excess air = 20 percent (percent of theoretical air)
Injection air = 22 percent (percent of theoretical air)
Overfire air = 9.5 percent (percent of theoretical air)
Secondary air preheat temperature = 450° F.
Injection air velocity = 138 ft/sec
Purge air velocity = 65 ft/sec
Fuel tube, air injector angle form diagonal = 6°

The fireball at the center of the furnace was observed to be tight and there was no wall flame impingement. Nitrogen oxide (NO) emissions were measured to be 340 ppm (dry, corrected to 3 percent $O_2$) which corresponds to 0.45 lb $NO_2$/million Btu, which also is below Federal NSPS requirements.

In the operation of the burners in accordance with the invention, the purge air flow, the primary air and pulverized SRC fuel flow, the secondary air flow, etc. are all maintained under conditions of volume, velocity and temperature so that sticking of SRC fuel on the exposed exterior surfaces of the burner components is avoided by preventing the SRC from impinging on the somewhat cooled surfaces. When these conditions are maintained, coking and fouling of the burner components by deposits of SRC is prevented.

While the invention has been described with respect to a specific embodiment, it will be understood that various modifications, alternate constructions and equivalents may be employed without departing from the scope of the invention. For example, while the above-described invention is directed to the firing of pulverized SRC fuel, the principles of the invention could be applicable to fuels which behave like solvent refined coal. Illustrative of such fuels are heavy bottoms from petroleum refined vacuum towers or bottoms from coke byproduct plants such as coal derived pitch.

We claim:

1. A high velocity air-purged solvent refined coal burner for the firing of pulverized solvent refined coal fuel away from a hot burner surface in a furnace comprising:

an imperforate fuel tube having a relative uniform diameter throughout the length of said tube and having an inlet end and a discharge end with an end tip, a second tube concentric with the uniform diameter of said fuel tube and cooperating therewith to define an annular passage of uniform cross-sectional dimension between said tubes having an inlet end and a discharge end, means for supplying a mixture of air and pulverized solvent refined coal fuel to the inlet end of said imperforate uniform diameter fuel tube at a high velocity to cause said mixture to flow through said fuel tube under flow conditions to substantially avoid impingement of said admixture on said hot burner surfaces and to provide the burner flame will be situated away from said tip of said imperforate uniform diameter fuel tube to reduce the amount that said imperforate uniform diameter fuel tube is heated by the burner flame and to prevent agglomeration of said solvent refined coal on the tip of said burner, and means for supplying purging air to said inlet end of said second tube to cause the purging air to flow through said annular passage at a high velocity and exit said outlet end of said second tube in a path directly parallel to the exit path of said fuel admixture exiting said imperforate uniform diameter fuel tube to move said fuel away from the burner tip and to thereby cool said fuel tube and avoid agglomeration of said solvent refined coal on said burner tip.

2. A burner according claim 1 wherein said distance that the flame is moved off said burner tip is from about 2–6 times the uniform diameter of said imperforate fuel tube.

3. A burner according to claim 1 wherein said burner flame is moved away from said burner tip a distance at least 6 times the uniform diameter of said imperforate fuel tube.

4. A burner according to claim 1 wherein said furnace is a tangentially fired furnace having a plurality of said burners arranged to fire into the furnace to produce a fireball in the center thereof.

5. A burner according to claim 3 wherein said furnace is a tangentially fired furnace having a plurality of said burners arranged to fire into the furnace to produce a fireball in the center thereof.

6. A burner according to claim 4 wherein the nominal firing conditions are approximately:

(1) firing rate = 1.45 million Btu/hr
(2) excess air = 20 percent of theoretical air
(3) injection air = 22 percent of theoretical air
(4) overfire air = 9.5 percent of theoretical air
(5) injection air velocity = 138 ft/sec, and
(6) purging air velocity = 65 ft/sec.

7. A burner according to claim 1 wherein said concentric annular passage provides a straight flow path for the passage of purge air and said imperforate uniform diameter fuel tube provides a straight flow path for the passage of fuel admixture so that both said purge air and said fuel admixture egress from the outlet of said annular passage and imperforate uniform diameter fuel tube in parallel relationship to avoid a swirling admixture of said two egressing streams.

* * * * *